US008434707B2

(12) United States Patent
Tada et al.

(10) Patent No.: US 8,434,707 B2
(45) Date of Patent: May 7, 2013

(54) APPARATUS FOR FRACTURING POLYCRYSTALLINE SILICON AND METHOD FOR PRODUCING FRACTURED FRAGMENTS OF POLYCRYSTALLINE SILICON

(75) Inventors: Ryusuke Tada, Saitama (JP); Takahiro Matsuzaki, Naka-gun (JP); Shunsuke Kotaki, Naka-gun (JP); Motoki Sato, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 13/282,620

(22) Filed: Oct. 27, 2011

(65) Prior Publication Data

US 2012/0104125 A1 May 3, 2012

(30) Foreign Application Priority Data

Oct. 28, 2010 (JP) ..... 2010-242061

(51) Int. Cl.
*B02C 13/20* (2006.01)
*B02C 13/09* (2006.01)

(52) U.S. Cl.
USPC ..... 241/187; 241/189.1; 241/294

(58) Field of Classification Search ..... 241/189.1, 241/187, 293, 294, 191
See application file for complete search history.

(56) References Cited

U.S. PATENT DOCUMENTS

| | | | | |
|---|---|---|---|---|
| 3,878,995 | A * | 4/1975 | Nash | 241/79.1 |
| 5,524,839 | A * | 6/1996 | Schade et al. | 241/101.2 |
| 5,704,561 | A * | 1/1998 | Ansen et al. | 241/293 |
| 5,860,609 | A * | 1/1999 | Sommer et al. | 241/293 |
| 5,941,467 | A * | 8/1999 | McArdle et al. | 241/5 |
| 6,086,003 | A * | 7/2000 | Gunter et al. | 241/235 |
| 6,896,215 | B2 * | 5/2005 | Lucas et al. | 241/277 |
| 6,953,166 | B2 * | 10/2005 | Schenk | 241/79 |
| 8,240,589 | B2 * | 8/2012 | Sommer et al. | 241/295 |
| 2006/0070569 | A1 | 4/2006 | Andrejewski et al. | |
| 2006/0088970 | A1 | 4/2006 | Hesse et al. | |
| 2008/0185466 | A1 * | 8/2008 | Howard | 241/187 |
| 2009/0114748 | A1 | 5/2009 | Gruebl et al. | |

FOREIGN PATENT DOCUMENTS

| | | | |
|---|---|---|---|
| JP | 2006-122902 | A | 5/2006 |
| JP | 2006-192423 | A | 7/2006 |
| JP | 2009-531172 | A | 9/2009 |

* cited by examiner

*Primary Examiner* — Faye Francis
(74) *Attorney, Agent, or Firm* — Edwards Wildman Palmer LLP

(57) ABSTRACT

An apparatus for fracturing polycrystalline silicon having: a pair of rolls rotated in a counter direction each other around parallel axes; and a plurality of fracturing teeth units provided on outer peripheral surfaces of the rolls, arranged along a circumferential direction of the rolls, and have a plurality of fracturing teeth and fixing covers fixing the fracturing teeth on the outer peripheral surfaces of the rolls, in which: the fracturing teeth has flanges; and the fixing covers are formed as strips along a longitudinal direction of the rolls, and in which the fixing covers are fixed on the rolls in a state in which top ends of the fracturing teeth are protruded outward radially of the rolls from the fixing hole outward so as to hold the flanges between the fixing covers and the rolls.

5 Claims, 11 Drawing Sheets

APPARATUS FOR FRACTURING POLYCRYSTALLINE SILICON AND METHOD FOR PRODUCING FRACTURED FRAGMENTS OF POLYCRYSTALLINE SILICON

CROSS REFERENCE TO RELATED APPLICATIONS

This application is related to four co-pending applications, all of them entitled, "APPARATUS FOR FRACTURING POLYCRYSTALLINE SILICON AND METHOD FOR PRODUCING FRACTURED FRAGMENTS OF POLYCRYSTALLINE SILICON" filed concurrently herewith as follows: in the names of Ryusuke Tada and Motoki Sato which claims priority to Japanese Patent Application No. 2010-242063 filed Oct. 28, 2010; in the names of Ryusuke Tada and Motoki Sato which claims priority to Japanese Patent Application No. 2010-242062 filed Oct. 28, 2010; in the names of Takahiro Matsuzaki and Shunsuke Kotaki which claims priority to Japanese Patent Application No. 2010-242060 filed Oct. 28, 2010; and in the names of Takahiro Matsuzaki, Teruyoshi Komura, Shunsuke Kotaki and Motoki Sato which claims priority to Japanese Patent Application No. 2010-242059 filed Oct. 28, 2010, which co-pending applications are assigned to the assignee of the instant application and which co-pending applications are also incorporated by reference herein.

BACKGROUND OF THE INVENTION

1. Field of the Invention

The present invention relates to an apparatus for fracturing polycrystalline silicon which is raw material of semiconductor silicon or the like into fragments, and a method for producing fractured fragments of polycrystalline silicon using the apparatus for fracturing.

Priority is claimed on Japanese Patent Application No. 2010-242061, filed Oct. 28, 2010, the content of which is incorporated herein by reference.

2. Description of Related Art

A silicon wafer which is used for a semiconductor chip is manufactured from single-crystal silicon which is produced by, for example, Czochralski method ("CZ method"). For producing single-crystal silicon by the CZ method, for example, fractured fragments of polycrystalline silicon that is obtained by fracturing rod-shaped polycrystalline silicon formed by Siemens process is used.

For fracturing polycrystalline silicon, as shown in FIG. 11, a rod R of polycrystalline silicon is fractured to fragments C of a few millimeters to a few centimeters. In this process, it is typical to break the rod R into appropriate size by thermal shock or the like, and then further hit and break the fragments with a hammer directly. However, the process strains workers, so that it is inefficient to obtain fragments of appropriate size from rod-shaped polycrystalline silicon.

In Japanese Unexamined Patent Application, First Publication No. 2006-122902, a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

On the other hand, in Published Japanese Translation No. 2009-531172 of the PCT International Publication and Japanese Unexamined Patent Application, First Publication No. 2006-192423, apparatuses for fracturing roughly-crashed fragments of polycrystalline silicon are proposed. These apparatuses are double-roll crashers having two rolls and crashing the roughly-crashed fragments of polycrystalline silicon between the rolls.

Polycrystalline silicon can be efficiently fractured by those fracturing apparatuses. However, since polycrystalline silicon is hard, there is a case in which the teeth may be chipped or worn. When the teeth on the roll are simultaneously worn, it is adequate to replace the roll by a new one. However, it is not efficient to replace the whole roll if few of the fracturing teeth are chipped or worn.

SUMMARY OF THE INVENTION

Problems to be Solved by the Invention

The present invention is contrived in view of the circumstances, and an object of the present invention is to provide an apparatus which fractures polycrystalline silicon into desired size by fracturing teeth and in which only the chipped or worn fractured teeth can be replaced, and to provide a method for producing fractured fragments of polycrystalline silicon using the apparatus for fracturing.

An apparatus for fracturing polycrystalline silicon according to the present invention has: a pair of rolls which are rotated in a counter direction each other around parallel axes; and a plurality of fracturing teeth units provided on an outer peripheral surface of the rolls, which are arranged along a circumferential direction of the rolls, and which have a plurality of fracturing teeth and fixing covers fixing the fracturing teeth on the outer peripheral surfaces of the rolls. In the apparatus, the fracturing teeth has flanges which expand in diameter at a base part, and the fixing covers are formed as strips along a longitudinal direction of the rolls, in which a plurality of fixing holes for the fracturing teeth are formed along the longitudinal direction, and are fixed on the rolls in a state in which top ends of the fracturing teeth are protruded outward radially of the rolls from the fixing hole outward so as to hold the flanges between the fixing covers and the rolls. The apparatus fracturing fragments of polycrystalline silicon between the rolls.

In this apparatus for fracturing, polycrystalline silicon can be fractured efficiently by rolling the rolls so that the fracturing teeth strike polycrystalline silicon. Each of the fracturing teeth penetrates each of the fixing holes for the fracturing teeth of the fixing cover of the fracturing teeth unit so that the flange of the fracturing tooth is held between the fixing cover and the roll. Therefore, it is sufficient that the only a fracturing tooth which is chipped or worn is replace by a new one, so that a replacing work is easy.

In the apparatus for fracturing polycrystalline silicon, it is preferable that a flat part be formed on the outer peripheral surface of the roll in which an end surface of the flange of the fracturing tooth is in contact at a surface.

If the outer peripheral surface of the roll is cylindrical, the end surface of the fracturing tooth is partially in contact with the outer peripheral surface of the roll. However, since the outer peripheral surface of the roll and the end surface of the fracturing tooth are in contact with each other at the surfaces in the apparatus according to the present invention, a load is not applied partially and the roll and the fracturing tooth are stabilized. Therefore, the fracturing teeth are not swung, so that uniform fragments can be produced.

In the apparatus for fracturing polycrystalline silicon according to the present invention, it is preferable that both ends of the fixing cover of the fracturing teeth unit be fixed to the roll by screws, and a flat part be formed on the outer peripheral surface of the roll in which back surfaces of the both ends of the fixing cover are in contact with.

If the outer peripheral surface of the roll at the fixing part of the screws for the fixing cover is formed cylindrical, bending stress is generated on the screws fixing the fixing cover. However, since the fixing cover and the roll are in contact at surfaces, the fixing cover is stabilized and the breakage or the like thereof can be prevented.

In the apparatus for fracturing crystalline silicon according to the present invention, it is preferable that detention structure which restricts rotation of the fracturing teeth in the fixing hole for fracturing teeth be provided between the fracturing teeth and the fixing cover.

By the detention structure, polycrystalline silicon can be stably fractured since the fracturing teeth are restricted rotation.

In the apparatus for fracturing polycrystalline silicon according to the present invention, it is preferable that the fracturing teeth be formed from cemented carbide or silicon material; and an outer surface the fixing cover be coated by cemented carbide or silicon material.

By forming the fracturing teeth and the outer surface of the fixing cover from cemented carbide or silicon material, the fractured fragments of polycrystalline silicon can be prevented from being contaminated by impurity, so that high-quality polycrystalline silicon ad material for semiconductor silicon can be obtained.

A method for producing fractured fragments of polycrystalline silicon according to the present invention products the fractured fragments of polycrystalline silicon by using the apparatus for fracturing polycrystalline silicon described above.

Effects of the Invention

According to the present invention, polycrystalline silicon can be fractured continuously and efficiently by rotating the rolls. Also, since the fracturing teeth are fixed between the fixing cover of the fracturing teeth unit and the roll, it is easy to replace some of the fracturing teeth, and the maintenance of the apparatus is excellent.

DESCRIPTION OF THE PREFERRED EMBODIMENTS

Hereinafter, an embodiment of an apparatus for fracturing polycrystalline silicon according to the present invention and a method for producing fractured fragments of polycrystalline silicon using the apparatus will be described with reference to the drawings.

Figure 1:
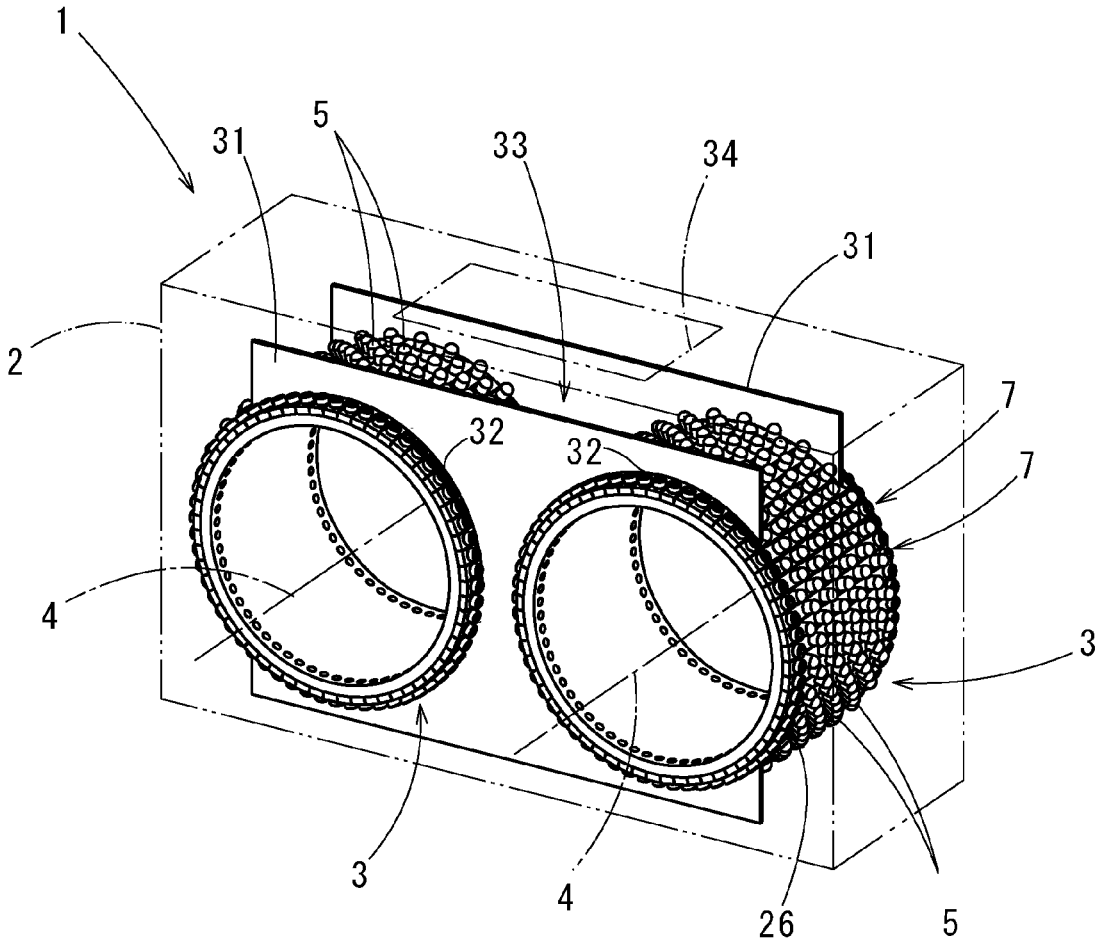
FIG. 1 is a partial perspective view showing an embodiment of an apparatus for fracturing polycrystalline silicon according to the present invention.
Figure 2:
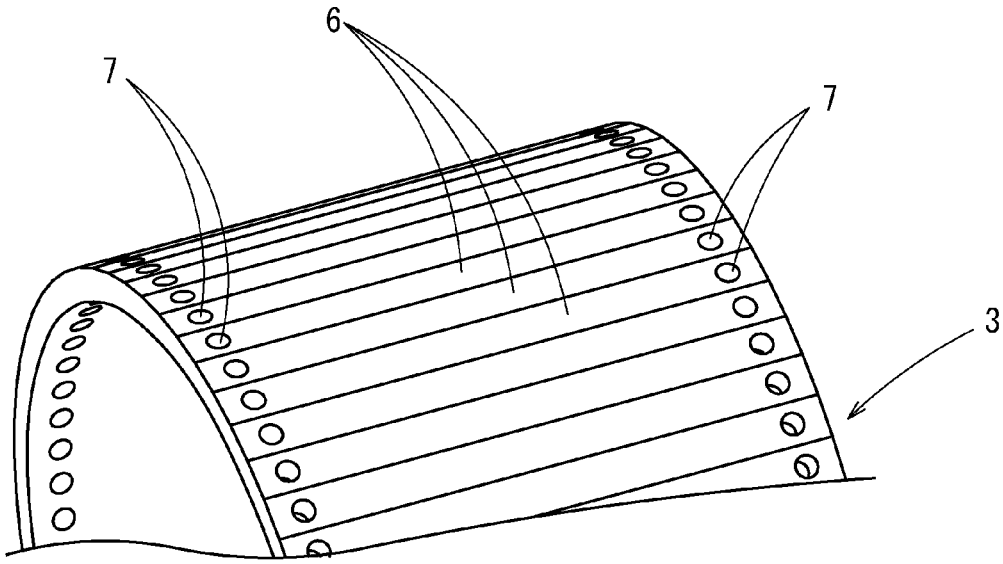
FIG. 2 is a perspective view showing a surface of roll of the apparatus for fracturing shown in FIG. 1.

As shown in FIG. 1, an apparatus 1 for fracturing (hereinafter, "the fracturing apparatus 1") of the present embodiment is provided with two rolls 3 which are arranged in a housing 2 so that axes 4 of the rolls 3 are horizontal and parallel with each other. A plurality of fracturing teeth 5 are provided on an outer peripheral surface of both the rolls 3 so as to protruding radially-outwardly. As shown in FIG. 2, the outer peripheral surfaces of the rolls 3 are not even arc surfaces, but are formed as a polyhedral shape configured from long planes 6 which are elongated along the axis direction and are connected along a circumferential direction. Threaded holes 7 are formed at both ends of the planes 6. On each of the planes 6, a fracturing teeth unit 8 is fixed.

Figure 3:
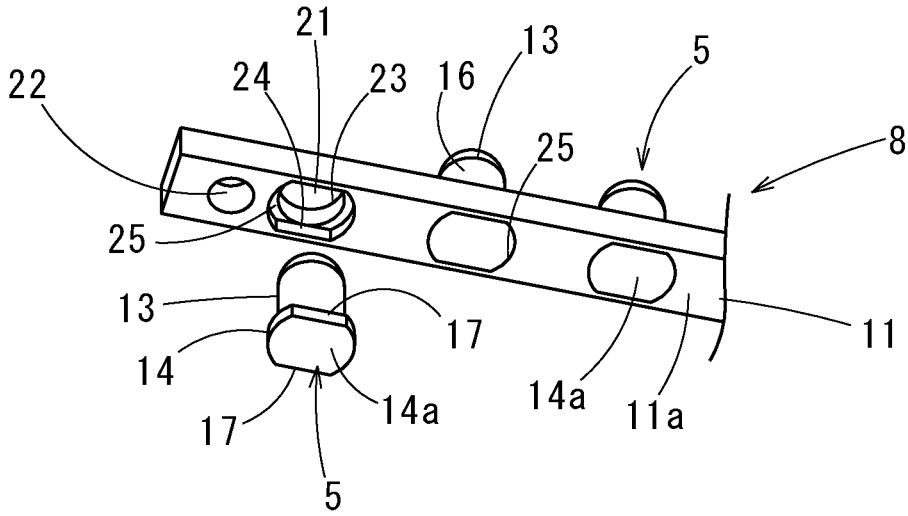
FIG. 3 is a perspective rear view showing a fracturing teeth unit installed in the apparatus for fracturing.
Figure 4:
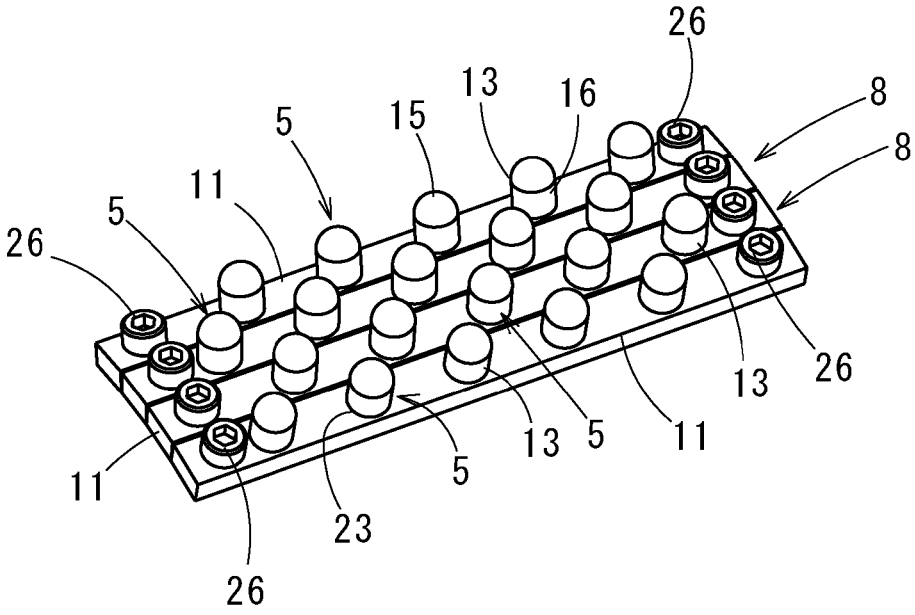
FIG. 4 is a perspective view showing a row of the plurality of the fracturing teeth units.

The fracturing teeth unit 8 is provided with a fixing cover 11 which is in contact with the plane 6 of the roll 3, and the plurality of fracturing teeth 5 which are fixed to the fixing cover 11 as shown in FIG. 3 and FIG. 4.

Figure 5:
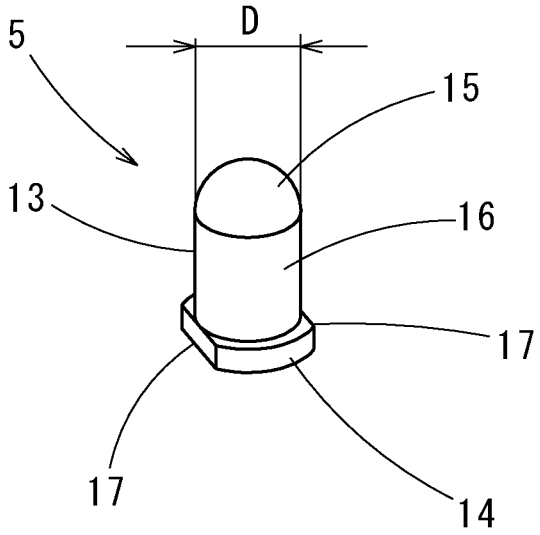
FIG. 5 is a perspective view showing the fracturing tooth.

The fracturing tooth 5 is formed as a unit from cemented carbide or silicon material, and has a column part 13 and a flange 14 which expands in diameter at a base part of the column part 13 as shown in FIG. 5. A top surface 15 of the column part 13 is formed spherically; and a side surface 16 of the column part 13 is formed cylindrically. The flange 14 is formed so that both sides of a circular plate are cut parallel to a longitudinal direction of the column part 13 (i.e., a longitudinal direction of the fracturing tooth 5), so that flat parts 17 are formed in 180° opposite direction from each other. An end surface of the flange 14 is formed as a flat plane 14*a* orthogonal to the longitudinal direction of the fracturing tooth 5.

The fixing cover 11 is formed as a strip having a same width and a same length as that of the plane 6 of the roll 3. Fixing holes 21 for fracturing teeth are formed with intervals along a longitudinal direction of the fixing cover 11 so as to penetrate the fixing cover 11. Through-holes 22 for screw are formed at both sides of the fixing cover 11. As shown in FIG. 3, each of the fixing holes 21 is configured with a fit hole 23 and an expanded part 25. The fit hole 23 is formed to a half depth of thickness of the fixing cover 11, and has a circular cross-section corresponding with the side surface 16 of the column part 13 of the fracturing tooth 5. The other half depth of the thickness of the fixing cover 11 of the fixing hole 21 is the expanded part 25 having flat parts 24 corresponding to the flange 14 of the fracturing tooth 5. The fracturing tooth 5 is fixed to the fixing cover 11 so as not to rotate by fitting into the expanded part 25 in a state in which the column part 13 is fitted into the fit hole 23 of the fixing cover 11 and by the flat parts 24 of the fixing cover 11 being in contact with the flat parts 17 of the flange 14. That is, detention structure for the fracturing tooth is constructed from the flat parts 24 of the fixing cover 11 and the flat parts 17 of the flange 14.

The fixing cover 11 is laid on each of the planes 6 of the rolls 3 in a state in which the expanded parts 25 face to the surfaces of the rolls 3 and the column parts 13 of the fracturing teeth 5 are protruded from the fit holes 23, and both ends of the fixing cover 11 are fixed to the surfaces of the rolls 3 by screws 26. In this fixing state, the flat plane 14*a* of the flange 14 of the fracturing tooth 5 and the plane 6 are in contact at surfaces with each other at the outer peripheral surface of the roll 3. Also, a back surface 11*a* of the fixing cover 11 and the plane 6 of the roll 3 are in contact at surfaces.

Figure 6:
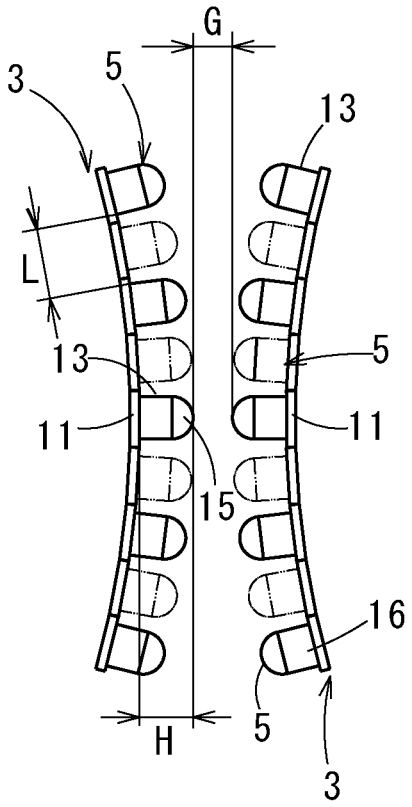
FIG. 6 is a front view showing a positional relation of the rolls at a facing part.

The fracturing teeth units 8 are arranged so that the fracturing teeth 5 of the adjacent fracturing units 8 are not rowed along the circumferential direction of the rolls 3, as shown in FIG. 4. That is, the adjacent fracturing teeth units 8 are installed on the rolls 3 so that the fracturing teeth 5 are arranged in a staggered manner. On the other hand, between the rolls 3, the fracturing teeth 5 are arranged so that the top surfaces 15 of the fracturing teeth 5 on the rolls 3 face each other at the facing part as shown in FIG. 6. In FIG. 6, among the staggered fracturing teeth 5, the fracturing teeth 5 arranged in a same circumferential row are denoted by continuous lines; and the fracturing teeth 5 arranged in the other circumferential row are denoted by two-dot lines.

In this embodiment, target size of fragments of polycrystalline silicon after fracturing (i.e., fractured fragments of polycrystalline silicon) is set in a range of 5 mm to 60 mm in maximum length. In order to obtain the fragments of such size: a diameter D of the column part 13 of the fracturing tooth 5 is set in a range of 10 mm to 14 mm; a protruding height H of the fracturing tooth 5 from the surface of the fixing cover 11 to the tip of the fracturing tooth 5 shown in FIG. 6 is set in a range of 10 mm to 30 mm; and a gap L between the adjacent fracturing tooth 5 is set in a range of 11 mm to 35 mm. Also, at the facing part of the rolls 3, a facing distance G between the top surfaces 15 of the fracturing teeth 5 is set in a range of 5 mm to 30 mm.

The housing 2 in which the rolls 3 are set is formed of resin such as polypropylene or the like, or formed of metal having an inner coating of tetrafluoroethylene in order to prevent contamination.

In the housing 2, a pair of partition plates 31 which cross the axes 4 of the rolls 3 are provided at both ends of the rolls 3 with a certain interval with respect to the inner wall surface of the housing 2 so as to be parallel with the inner wall surface of the housing 2. The partition plates 31 are fixed to the housing 2, have two cutouts 32 which are formed by being cut at circular arc shape with slightly larger diameter than that of the rolls 3 so as to engage the half or more of the rolls 3, and are arranged with spanning the rolls 3 in a state in which the cutouts 32 are engaged to the ends of the rolls 3.

In a state in which the partition plates 31 are engaged to the rolls 3, gaps are formed between inner peripheral surfaces of the cutouts 32 of the partition plates 31 and outer peripheral surfaces of the rolls 3 so as not to disturb the rotation of the rolls 3. Also, the screws 26 for fixing the fracturing teeth units 8 which are provided at both the ends of the rolls 3 are positioned outside the partition plates 31 so that spaces above and below the facing part of the rolls 3 are located between the partition plates 31. The space between the partition plates 31 is a fracturing space 33 for polycrystalline silicon. On an upper surface of the housing 2, an inlet 34 is formed so as to be arranged immediately above the fracturing space 33. The partition plates 31 are formed from resin such as polypropylene or the like or metal having inner coating of tetrafluoroethylene, as the housing 2.

The housing 2 is provided with a gearbox or the like (not shown) for rotary-driving the rolls 3. The gearbox is connected to an exhaust system (not shown) so as to exhaust the housing 2 and an inner space of the gearbox.

When fractured fragments of polycrystalline silicon is produced by using the fracturing apparatus 1 configured as described above, in a state of rolling the rolls 3, by supplying roughly-fractured polycrystalline silicon of appropriate size into the fracturing space 33 for polycrystalline silicon between the partition plates 31 through the inlet 34 of the housing 2, the fragments of polycrystalline silicon are further fractured into fragments between the fracturing teeth 5 of the rolls 3.

In the fracturing teeth 5, the top surfaces 15 are formed spherically, so that the top surfaces 15 and polycrystalline silicon are in contact at points. Also, in the fracturing teeth 5, the side surfaces 16 of the column parts 13 are formed cylindrically, so that the side surfaces 16 and polycrystalline silicon are in contact at points or in lines. Therefore, the fracturing teeth 5 impact polycrystalline silicon in a state of being in contact with polycrystalline silicon at points or in lines, so that polycrystalline silicon can be prevented from being crushed by planes.

The partition plates 31 which are arranged above the ends of the rolls 3 prevent the fragments of polycrystalline silicon which are fractured therebetween from being ground by entering between the inner wall surfaces of the housing 2 and the end surfaces of the rolls 3. Therefore, the fragments of polycrystalline silicon can be reliably fractured and pass through between the rolls 3.

As a result, in the fracturing apparatus 1, polycrystalline silicon can be fractured to of desired size, so that the powder can be prevented from being generated and the loss rate can be reduced.

Figure 7A:
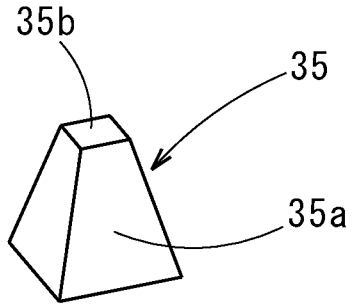
FIG. 7A is a perspective view showing truncated pyramid-shape fracturing teeth.
Figure 7B:
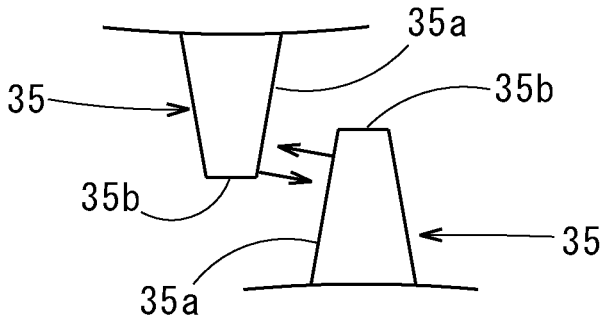
FIG. 7B is a front view showing the truncated pyramid-shape fracturing teeth at the facing part of the rolls.

Incidentally, if fracturing teeth 35 were formed into truncated pyramid-shape as shown in FIG. 7A, there is a case in which polycrystalline silicon is wedged between flat parts 35*a* of the fracturing teeth 35 and crushed, so that powder is generated owing to surface-contact as shown in FIG. 7B. In the comparative example shown in FIG. 7A and FIG. 7B, since top surfaces 35*b* of the fracturing teeth 35 are also formed into flat planes, polycrystalline silicon is ground also by the top surfaces 35*b*.

It is difficult to prevent generating of powder when using the fracturing teeth having flat planes. On the other hand, in the fracturing teeth according to the present invention, the top of the column part is formed spherically and the side surface of the column part is formed cylindrically, so that the powder can be reduced.

In the fracturing process, since the flat plane 14*a* of the flange 14 of the fracturing tooth 5 and the plane 6 of the roll 3 are in contact with each other at surfaces, the fracturing tooth 5 receives fracturing impact at the contact surface, so that the fracturing is stabilized in the intensity. Therefore, the fracturing teeth 5 are not swung, so that uniform fragments can be produced.

Also, since the back surface 11*a* of the fixing cover 11 and the plane 6 of the roll 3 are in contact with each other at surfaces, the fixing cover 11 is not swung by the impact received at the fracturing teeth 5. Therefore, since bending moment is not applied to the screws 26 fixing the fixing cover 11 to the roll 3, the fixing structure can be maintained, and breakage or the like can be prevented.

Furthermore, in the fracturing apparatus 1, since the fracturing teeth 5 are formed from cemented carbide or silicon material, impurities are prevented from contaminating polycrystalline silicon from the fracturing teeth 5. Although the screws 26 which fix the fracturing teeth units 8 are generally made of metal, the screws 26 are not in contact with polycrystalline silicon since the screws 26 are arranged outside the fracturing space 33 for polycrystalline silicon. Furthermore, the partition plates 31 and the housing 2 surrounding the fracturing space 33 for polycrystalline silicon are made from resin such as polypropylene or the like, or are coated by tetrafluoroethylene. Therefore, polycrystalline silicon can be prevented from being contaminated by impurities while fracturing. As a result, according to the fracturing apparatus 1, high-quality polycrystalline silicon for semiconductor material can be obtained.

Furthermore, in the present embodiment, the fracturing teeth units 8 in which the fixing cover 11 holds the fracturing teeth 5 independently with each other are fixed on the surface of the rolls 3. Therefore, when some fracturing teeth 5 are fallen or chip away, it is sufficient to replace the defective fracturing teeth 5. In this case, since the fracturing teeth units 8 are fixed to the rolls 3 by the screws 26 and the fracturing teeth 5 are only fitted into the fixing holes 21 for fracturing teeth of the fixing cover 11, it is easy to replace some of the fracturing teeth 5. As a result, maintenance work such as replacement, polishing or the like of the fracturing teeth 5 is easy.

Figure 8:
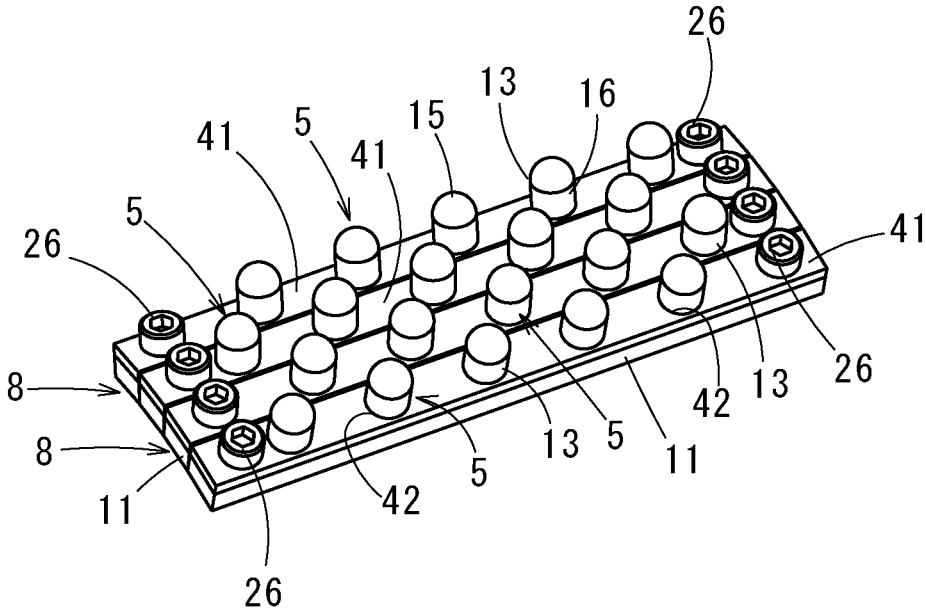
FIG. 8 is a perspective view showing the other example of the fracturing teeth unit as FIG. 4.

It is preferable that the fixing cover 11 be made of stainless steel or the like in order to maintain strength. Also, as shown in FIG. 8, the fixing cover 11 may be provided with covers 41 made of cemented carbide or silicon material having a same width and a same length as that of the fixing cover 11. In the covers 41, holes 42 into which the column parts 13 of the fracturing teeth 5 or the screws 26 are inserted are formed. Note, only symbols of the holes 42 for the column parts 13 of the fracturing teeth 5 are denoted in FIG. 8. The covers 41 are fixed to the roll unitarily. By providing the covers 41, contamination can be prevented even though surfaces of the cover 41 are in contact with polycrystalline silicon. Instead of the covers 41, the surfaces of the fixing covers 11 may be coated by resin such as polypropylene, tetrafluoroethylene or the like.

Figure 9:
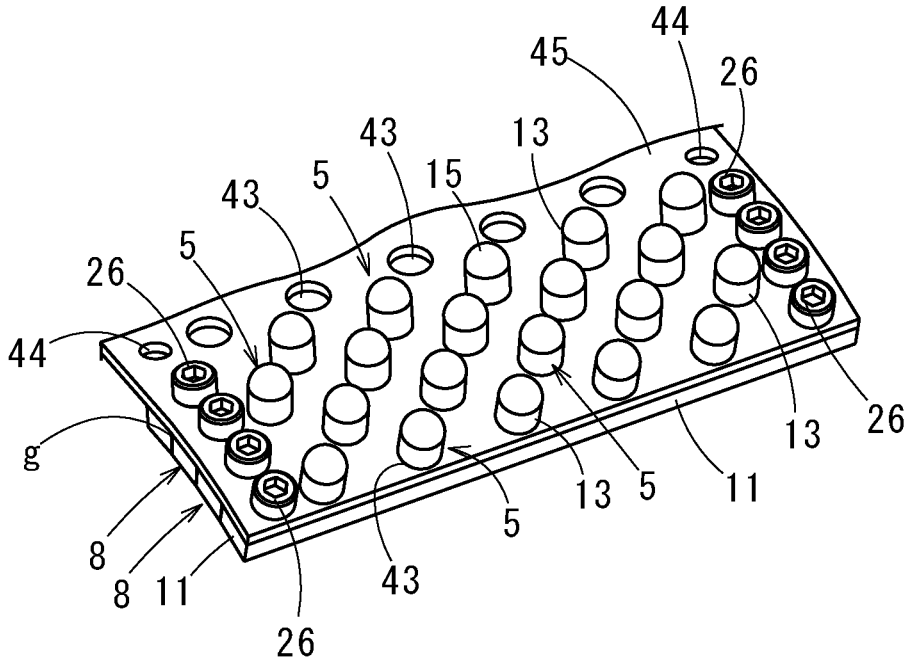
FIG. 9 is a perspective view showing a substantial part of the fracturing teeth units in a state in which the units are coated with a resin cover.

As shown in FIG. 9, a resin cover 45 made from polypropylene or the like may be provided around the fixing covers 11 on the outer peripheral surface of the roll. The resin cover 45 has a plurality of holes 43 and 44 in which the fracturing teeth 5 or the screws 26 are penetrated, and formed as a sheet-shape which can cover round the outer peripheral surface of the roll in a state in which the column parts 13 of the fracturing teeth 5 are inserted in the holes 43. When the resin cover 45 is provided, small gaps "g" (see FIG. 10A) which are formed between the fixing covers 11 of the fracturing teeth units 8 are also covered, so that the gaps "g" are prevented from being adhered by the powders or the like. When the resin cover 45 is worn, the resin cover 45 can be replaced.

Figure 10A:
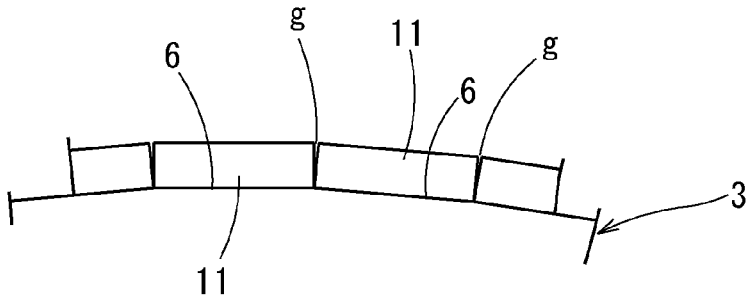
FIG. 10 is a front view showing a substantial part of a modified example of the fixing cover of the fracturing teeth unit.
Figure 10B:
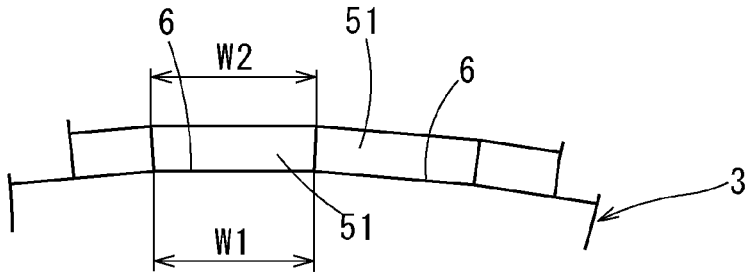
Figure 11:
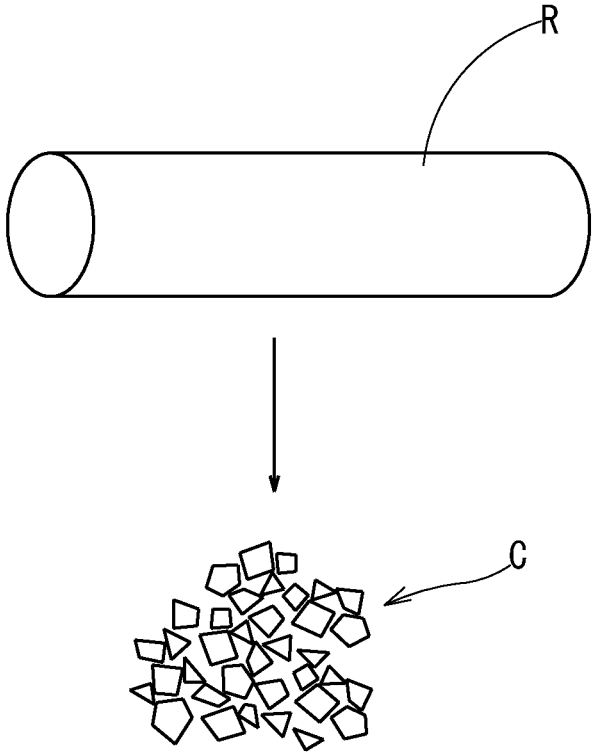
FIG. 11 is a schematic view showing fragments obtained by fracturing a rod of polycrystalline silicon.

The above-described fixing covers 11 of the fracturing teeth units 8 are shown in FIG. 10A; and a modified example thereof is shown in FIG. 10B. As shown in FIG. 10B, the fixing covers 51 may be formed so as to have a cross section of a part of fan-shape instead of rectangle. That is, in the fixing cover 51, a width W1 at a back surface is the wider than a width W2 at a upper surface, so that the gaps "g" as shown in FIG. 10A are not formed between the upper surfaces of the fixing covers 51 when the fixing covers 51 are laid on the outer peripheral surface of the roll 3 and fixed on the planes 6.

By forming the fixing cover 51 as above, since side surfaces of the adjacent fixing covers 51 are in contact with each other, the fixing covers 51 are stabilized with each other, and the fixing covers 51 are not swung by the impact received at the fracturing teeth 5. Therefore, since bending moment is not applied to the screws 26 fixing the fixing cover 51 to the roll 3, the fixing structure can be maintained, and breakage or the like can be prevented.

The present invention is not limited to the above-described embodiments and various modifications may be made without departing from the scope of the present invention.

For example, the top surfaces of the fracturing teeth are faced each other at the facing part of the rolls in the above embodiment. However, the fracturing teeth of one roll may be arranged so as to be faced to gaps between the fracturing teeth of the other roll.

Also, dimensions of the facing gaps or the like of the fracturing teeth are not limited to the above-described embodiments. The side surfaces of the column parts of the fracturing teeth are formed cylindrically in the above embodiments. However, the side surfaces may be formed conically. Furthermore, the tips of the fracturing teeth may be formed conically so as to be connected with the spherical top surfaces and a cylindrical base part.

The detention structure of the fracturing teeth may have a structure of abutting the flat planes with each other in the above embodiment, or a structure of fitting projections and dimples as spline.

What is claimed is:

1. An apparatus for fracturing polycrystalline silicon comprising:

a pair of rolls which are rotated in a counter direction each other around parallel axes; and a plurality of fracturing teeth units which are provided on outer peripheral surfaces of the rolls, which are arranged along a circumferential direction of the rolls, and which have a plurality of fracturing teeth and fixing covers fixing the fracturing teeth on the outer peripheral surfaces of the rolls, wherein the fracturing teeth has flanges which expand in diameter at a base part, and the fixing covers are formed as strips along a longitudinal direction of the rolls, in which a plurality of fixing holes for the fracturing teeth are formed along the longitudinal direction, and are fixed on the rolls in a state in which top ends of the fracturing teeth are protruded outward radially of the rolls from the fixing hole outward so as to hold the flanges between the fixing covers and the rolls, the apparatus fracturing fragments of polycrystalline silicon between the rolls.

2. The apparatus for fracturing polycrystalline silicon according to claim 1, wherein a flat part is formed on the outer peripheral surface of the roll in which an end surface of the flange of the fracturing tooth is in contact at a surface.

3. The apparatus for fracturing polycrystalline silicon according to claim 1, wherein both ends of the fixing cover of the fracturing teeth unit are fixed to the roll by screws; and a flat part is formed on the outer peripheral surface of the roll in which back surfaces of the both ends of the fixing cover are in contact with.

4. The apparatus for fracturing polycrystalline silicon according to claim 1, wherein detention structure which restricts rotation of the fracturing teeth in the fixing hole for fracturing teeth is provided between the fracturing teeth and the fixing cover.

5. The apparatus for fracturing polycrystalline silicon according to claim 1, wherein the fracturing teeth are formed from cemented carbide or silicon material; and an outer surface the fixing cover is coated by cemented carbide or silicon material.

* * * * *